US005678514A

United States Patent [19]

Mazzella et al.

[11] Patent Number: 5,678,514

[45] Date of Patent: Oct. 21, 1997

[54] VALVE LIFTER RETAINER FOR AN INTERNAL COMBUSTION ENGINE

[75] Inventors: Richard Salvatore Mazzella, Eastpointe; Michael Joseph Schrader, Belleville, both of Mich.

[73] Assignee: Ford Global Technologies, Inc., Dearborn, Mich.

[21] Appl. No.: 626,561

[22] Filed: Apr. 2, 1996

[51] Int. Cl.[6] ..... F01L 1/14

[52] U.S. Cl. ..... 123/90.5

[58] Field of Search ..... 123/90.48, 90.5; 74/569

[56] References Cited

U.S. PATENT DOCUMENTS

| | | | |
|---|---|---|---|
| 2,089,478 | 8/1937 | Heiss | 123/90.5 |
| 3,089,472 | 5/1963 | Thompson | 123/90.5 |
| 3,108,580 | 10/1963 | Crane, Jr. | 123/90.5 |
| 3,795,229 | 3/1974 | Weber | 123/90.5 |
| 3,886,808 | 6/1975 | Weber | 123/90.5 |
| 3,998,190 | 12/1976 | Keske | 123/90.5 |
| 4,207,775 | 6/1980 | Lintott | 123/90.5 |
| 4,448,155 | 5/1984 | Hillebrand et al. | 123/90.5 |
| 5,022,356 | 6/1991 | Morel, Jr. et al. | 123/90.5 |
| 5,088,455 | 2/1992 | Moretz | 123/90.5 |
| 5,263,386 | 11/1993 | Campbell et al. | 123/90.5 |
| 5,273,005 | 12/1993 | Philo et al. | 123/90.5 |
| 5,307,769 | 5/1994 | Meagher et al. | 123/90.5 |
| 5,361,733 | 11/1994 | Spath et al. | 123/90.5 |
| 5,431,133 | 7/1995 | Spath et al. | 123/90.5 |

*Primary Examiner*—Weilun Lo
*Attorney, Agent, or Firm*—Neil P. Ferraro

[57] ABSTRACT

A retainer for a retaining valve lifters in an internal combustion engine. The retainer has a plurality of valve lifter receiving sockets spaced along the length thereof for receiving the lifters. To secure the retainer in the engine, a resilient biasing element is attached to the retainer body such that when the cylinder head is mounted to the cylinder block, the resilient biasing element is flexed, thereby applying a normal force on the retainer to secure the retainer between the cylinder block and the cylinder head.

19 Claims, 3 Drawing Sheets

VALVE LIFTER RETAINER FOR AN INTERNAL COMBUSTION ENGINE

FIELD OF THE INVENTION

The present invention relates generally to a retainer for valve lifters for overhead valve internal combustion engines and, more particularly, to a resilient biasing element for securing the retainer in the engine.

BACKGROUND OF THE INVENTION

Overhead valve internal combustion engines typically have roller valve lifters engaging cam lobes on a camshaft. It is well known that roller valve lifters must not rotate about their longitudinal axes, because the roller on the lifter must remain in the same plane as the cam lobe.

Certain prior art devices properly orient the lifter in the cylinder block of an internal combustion engine to prevent the above-mentioned rotation. U.S. Pat. No. 5,088,455 is exemplary of such a device. As shown in FIG. 1, a prior art retainer 10 is fastened to cylinder block 12 of engine 14 by bolts 16. The inventors of the present invention have recognized a disadvantage in using bolts to secure the retainer to an engine block. For example, during installation of prior art retainer 10, the bolts 16 must be properly aligned with the threaded holes and tightened to the proper torque. Otherwise, the bolts may strip or may be improperly tightened. In addition, using bolts requires additional assembly time. And, additional cost results from the need to drill and tap holes for the retainer bolts.

SUMMARY OF THE INVENTION

An object of the present invention is to provide a retainer for valve lifters that is easy to install during engine assembly.

This object is achieved, and disadvantages of prior approaches overcome, by providing a novel retainer for retaining valve lifters in an internal combustion engine. The engine includes valve lifters installed in a cylinder block and a cylinder head attached to the cylinder block. Each valve lifter has a longitudinal axis. The retainer includes an elongate body having a plurality of valve lifter receiving sockets spaced along the length thereof for receiving the lifters. A resilient biasing element is attached to the body of the retainer so that the retainer may be secured between the cylinder block and the cylinder head when the cylinder head is mounted to the cylinder block.

In a preferred embodiment, the resilient biasing element is a leaf spring contained within a groove in the retainer. Thus, during assembly of the engine, the retainer may simply be placed in the engine block to engage with the valve lifters. The cylinder head is then fastened to the cylinder block, causing the leaf springs to compress, thereby securing the retainer to the engine. Of course, other resilient biasing elements may be used including, but not limited to, a coil spring, a rubber bushing, a spring washer or even a cantilevered spring element integrally formed on the body of the retainer.

An advantage of the present invention is that assembly of the engine may be simplified thereby saving time and reducing costs.

Another advantage of the present invention is that by attaching the resilient biasing element to the retainer, alignment of the resilient biasing element relative to the retainer during assembly of the engine may be accomplished without the use or need of any fixturing devices.

Still, another advantage of the present invention is that the proper amount of force applied to the retainer may be obtained without relying on an installer to properly torque any fasteners.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
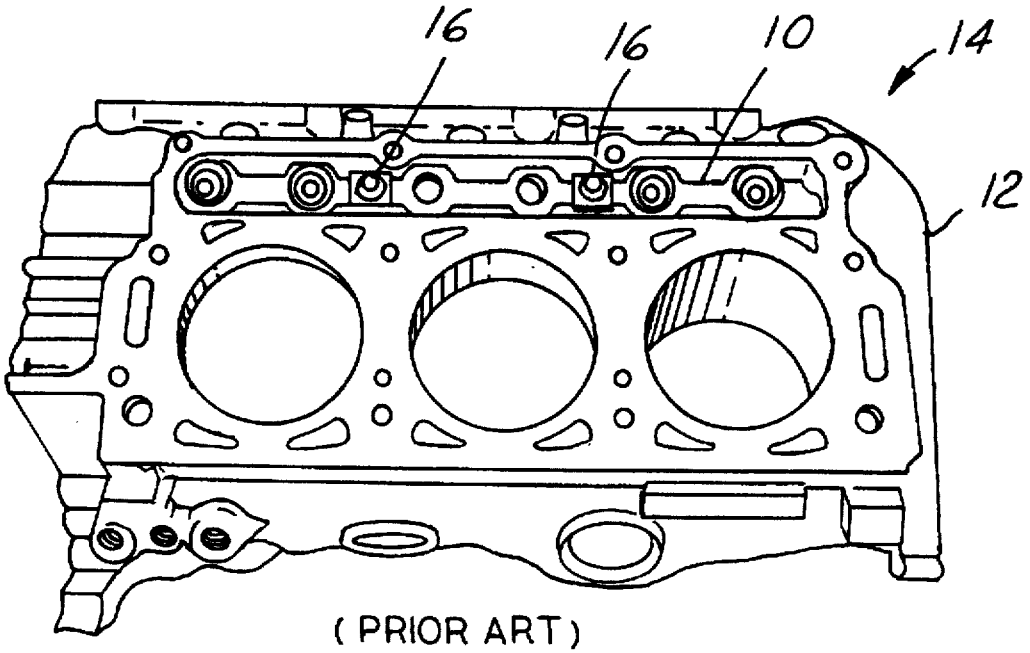
( PRIOR ART ) FIG. 1
FIG. 1 is a diagrammatic perspective representation of a prior art retainer fastened to an engine cylinder block.
Figure 2:
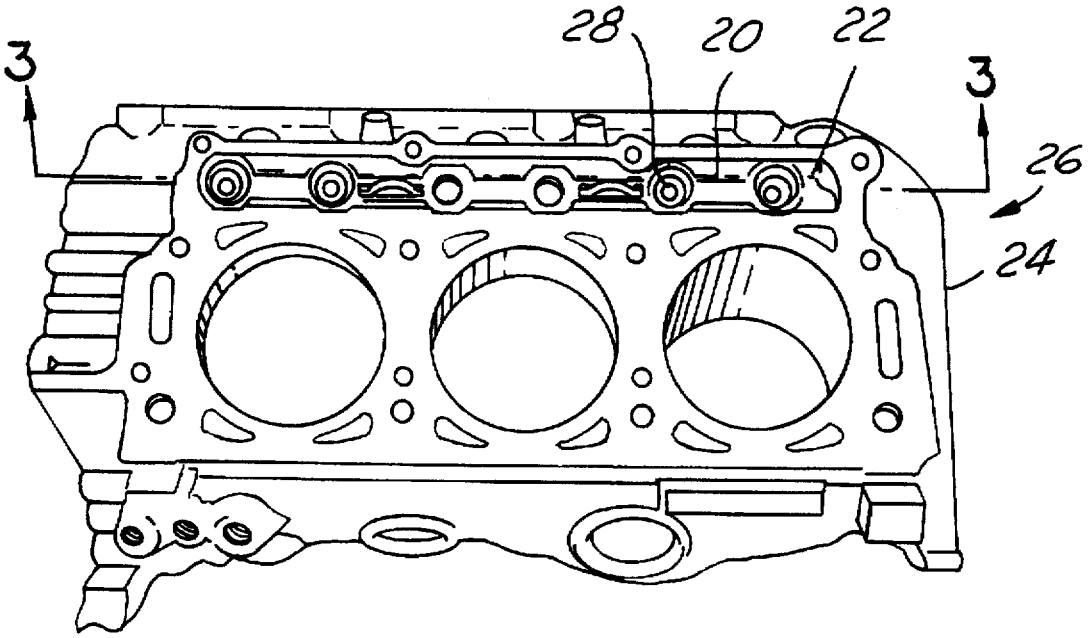
FIG. 2 is a retainer according to the present invention in an engine cylinder block.
Figure 3:
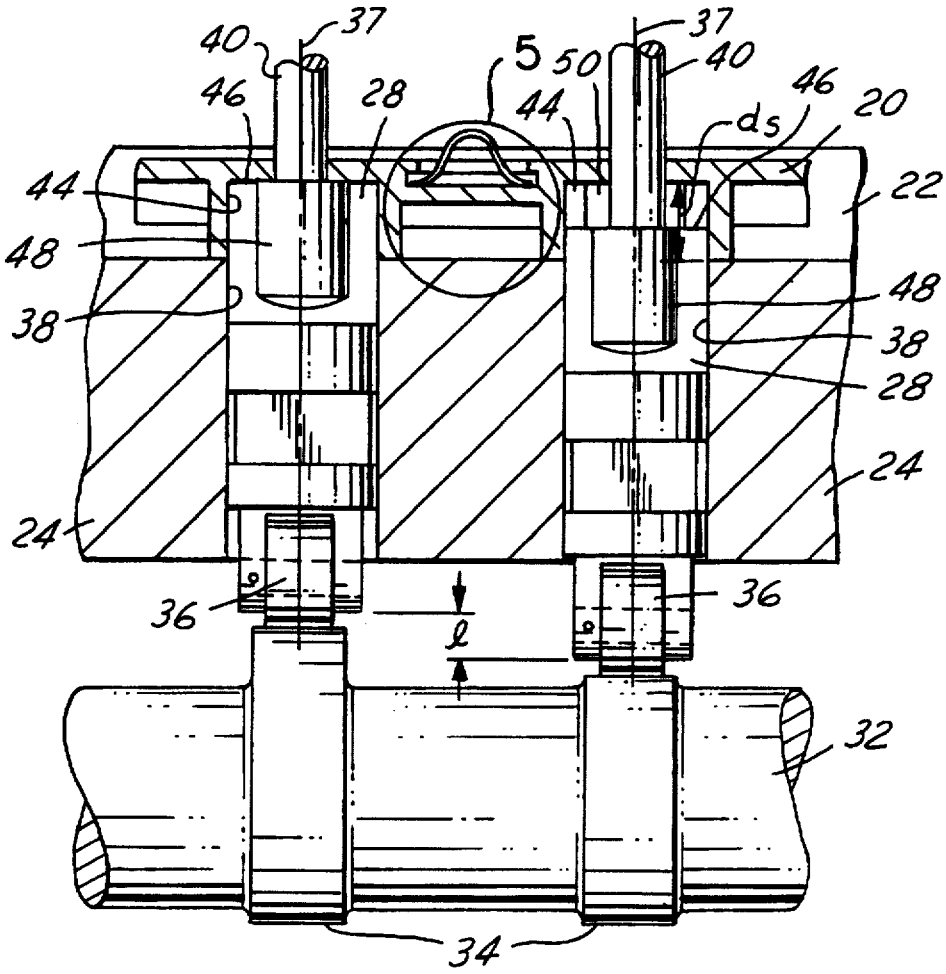
FIG. 3 is a partial cross-section view taken along line 3—3 of FIG. 2.

Valve lifter retainer 20, shown in FIGS. 2 and 3, is positioned in retainer groove 22 formed in cylinder block 24 of engine 26. As is well known to those skilled in the art, engine 26 has camshaft 32, having a plurality of camshaft lobes 34 spaced along the length thereof, rotatably mounted to cylinder block 24. As camshaft 32 rotates, lobes 34 contact rollers 36 of lifters 28 causing lifters 28 to reciprocate in lifter bore 38 formed in engine block 24. As lifters 28 reciprocate, push rods 40 open and close intake and exhaust valves (not shown).

Retainer 20 is provided with a plurality of valve lifter receiving sockets 44 (see also FIG. 4) for receiving ends 46 of lifters 28. To prevent lifters 28 from binding as they reciprocate in bores 38, lifters 28 must not rotate about axis 47. This is accomplished by providing, for example, flats 48 on the outer surface of lifters 28 cooperating with flats 50 (FIG. 4) in sockets 44. Those skilled in the art will recognize in view of this disclosure that to effectively prevent the above mentioned rotation, the depth ds of each socket 44 must be greater than the amount of lift 1 through which each valve lifter 28 moves, so that lifter 28 will not become disengaged from within socket 44.

Figure 4:
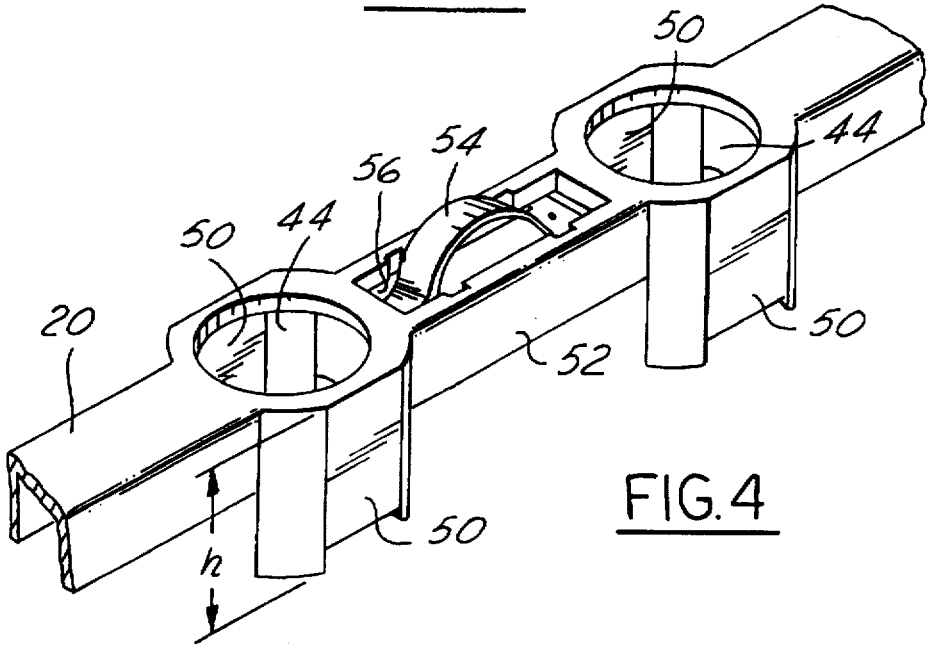
FIG. 4 is a partial perspective view of the retainer according to the present invention.
Figure 5:
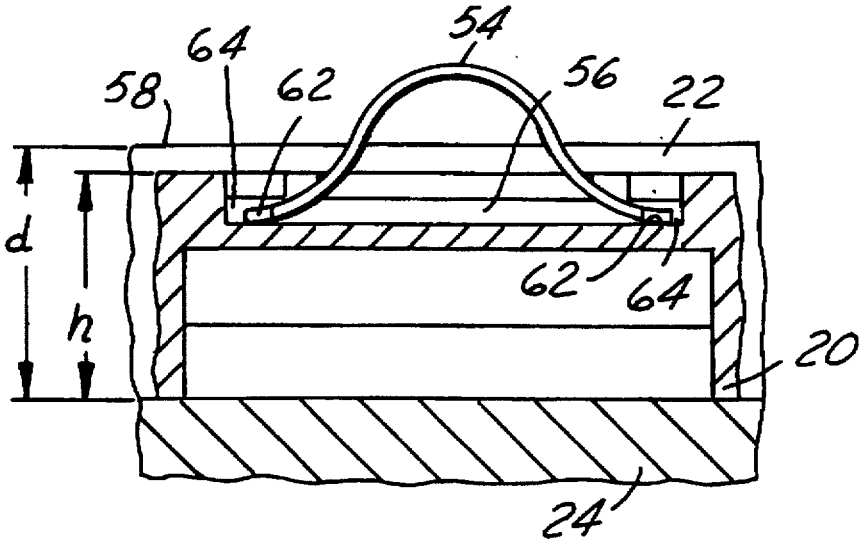
FIG. 5 is an enlarged view of the area encircled by line 5 of FIG. 3; and, FIG. 6 is an enlarged view showing a portion of the retainer as installed in the engine.
Figure 6:
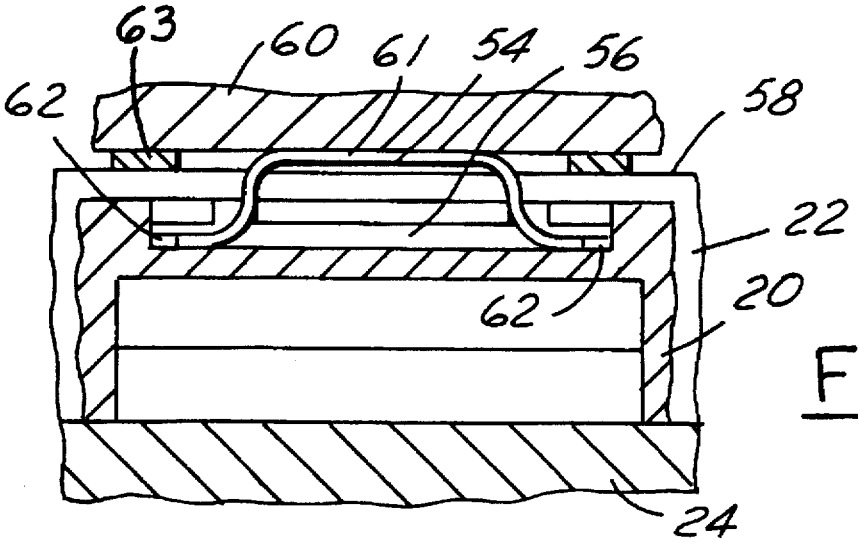

Referring now to FIGS. 4–6, according to the present invention, retainer 20 includes elongate body 52 having height h. Retainer 20 further includes resilient biasing element 54, such as a U-shaped leaf spring, retained in a groove 56 formed between adjacent sockets 44. Those skilled in the art will recognize in view of this disclosure that resilient biasing element 54 may comprise other spring elements including, but not limited to, a coil spring, a rubber bushing, a spring washer or even a cantilevered spring element integrally formed on body 52.

As best shown in FIGS. 5 and 6, retainer 20 is placed in retainer groove 22 of cylinder block 24. According to the present invention, height h of retainer 20 is less than depth d of groove 22 as measured from top surface 58 of cylinder block 24. Thus, when cylinder head 60 (FIG. 6) is attached to cylinder block 24, preferably with head gasket 63 therebetween, bight 61 of U-shaped leaf spring 54 contacts cylinder head 60, causing leaf spring 54 to compress, thereby applying a normal force to retainer 20 so as to secure retainer 20 in groove 22. Thus, no fasteners are required to secure retainer 20 to cylinder block 24. Those skilled in the art will recognize in view of the disclosure that groove 22 may be alternatively formed in cylinder head 60, provided that leaf spring 54 is able to flex.

In addition to d being greater than h, to further entrance flexing of leaf spring 54 when cylinder head 60 is attached to cylinder block 24, it is desirable to provide groove 56 with a length greater then the length between ends 62 of unflexed leaf spring 54. The difference between these two distances define space 64 between end 62 and the end of groove 56. Thus, when cylinder head 60 is mounted to engine block 24, leaf spring 54 can move longitudinally within groove 56 as shown in FIG. 6.

While the best mode for carrying out the invention has been described in detail, those skilled in the art in which this invention relates will recognize various alternative designs and embodiments, including those mentioned above, in practicing the invention that has been defined by the following claims.

We claim:

1. A retainer for retaining valve lifters in an internal combustion engine, the engine having a cylinder block and a cylinder head attached to the cylinder block, each lifter having a longitudinal axis, with said retainer comprising:

an elongate body having a plurality of valve lifter receiving sockets spaced along the length thereof for receiving the lifters; and, a resilient biasing element attached to said body for securing said retainer between the cylinder block and the cylinder head when the cylinder head is mounted to the cylinder block.

2. A retainer according to claim 1 wherein said resilient biasing element is a leaf spring.

3. A retainer according to claim 2 wherein said body further comprises a groove at least partially extending along the length of said body between said adjacent sockets for receiving an end of said leaf spring.

4. A retainer according to claim 3 wherein said groove is sufficiently long to allow said leaf spring to move longitudinally within said groove when said leaf spring is flexed.

5. A retainer according to claim 1 further comprising spaced opposing flat sides in each said socket for cooperating with radially spaced opposed flat sides on the lifter for preventing rotation of the lifter about the lifter's longitudinal axis.

6. A retainer according to claim 2 wherein said leaf spring is U-shaped having a bight in contact with the cylinder head when the cylinder head is mounted to the cylinder block.

7. An overhead valve internal combustion engine comprising:

a cylinder block;

a camshaft having a plurality of cam lobes spaced therealong, with said camshaft being rotatably mounted in said cylinder block;

a plurality of valve lifters, with each lifter being at least partially housed in a bore in said cylinder block and contacting one of said lobes;

a cylinder head mounted to said cylinder block; and, a retainer positioned between said cylinder block and said cylinder head, with said retainer having an elongate body defining a length and height, a plurality of valve lifter receiving sockets spaced along the length of said body, with each said socket receiving the lifter, and a resilient biasing element attached to said body for securing said retainer between said cylinder block and said cylinder head.

8. An engine according to claim 7 wherein said cylinder block comprises a retainer groove extending substantially along the length of said cylinder block and having a depth greater than the height of said retainer body, with said retainer groove receiving said retainer.

9. An engine according to claim 7 wherein each said lifter reciprocates in said bore and in said socket upon rotation of said camshaft thereby defining a lift, with each said socket having a depth greater than said lift to prevent said lifter from disengaging from within said socket.

10. An engine according to claim 7 wherein each said socket has spaced opposed flat sides and each said lifter has radially spaced opposed flat sides adjacent said lifter end for cooperating with said flat sides in said socket for preventing rotation of the lifter about the lifter's longitudinal axis.

11. An engine according to claim 7 wherein said resilient biasing element is a leaf spring.

12. An engine according to claim 11 wherein said body further comprises a groove at least partially extending along the length of said body for receiving an end of said leaf spring.

13. An engine according to claim 12 wherein said groove is sufficiently long to allow said leaf spring to move longitudinally within said groove when said leaf spring is flexed.

14. An engine according to claim 11 wherein said leaf spring is U-shaped having a bight in contact with said cylinder head when said cylinder head is mounted to said cylinder block.

15. An engine according to claim 7 wherein said resilient biasing element is located between adjacent sockets.

16. A retainer for retaining roller valve lifters in an internal combustion engine, the engine having a cylinder block and a cylinder head attached to the cylinder block, each lifter having a longitudinal axis, with said retainer comprising:

an elongate body having a plurality of roller valve lifter receiving sockets spaced along the length thereof, with each said socket receiving and cooperating with the lifter to prevent rotation of the lifter about the lifter longitudinal axis; and, a resilient biasing element attached to said body for securing said retainer between the cylinder block and the cylinder head when the cylinder head is mounted to the cylinder block.

17. A retainer according to claim 16 wherein said resilient biasing element is a U-shaped leaf spring having a bight in contact with the cylinder head when the cylinder head is mounted to the cylinder block.

18. A retainer according to claim 17 wherein said body further comprises a groove at least partially extending along the length of said body between said adjacent sockets for receiving ends of said U-shaped leaf spring.

19. A retainer according to claim 18 wherein said groove is sufficiently long to allow said U-shaped leaf spring to move longitudinally within said groove when said U-shaped leaf spring is flexed.

* * * * *